US006527651B1

(12) United States Patent
Umezawa et al.

(10) Patent No.: US 6,527,651 B1
(45) Date of Patent: Mar. 4, 2003

(54) WOUND GOLF BALL

(75) Inventors: Junji Umezawa, Chichibu (JP); Jun Shindo, Chichibu (JP); Shinichi Kakiuchi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 144 days.

(21) Appl. No.: 09/609,925

(22) Filed: Jul. 5, 2000

(30) Foreign Application Priority Data

Jul. 5, 1999 (JP) ..... 11-190213

(51) Int. Cl.[7] ..... A63B 37/06
(52) U.S. Cl. ..... 473/357
(58) Field of Search ..... 473/356, 357, 473/362

(56) References Cited

U.S. PATENT DOCUMENTS

| | | | | |
|---|---|---|---|---|
| 5,397,129 A | | 3/1995 | Kato et al. | 273/227 |
| 5,445,387 A | | 8/1995 | Maruko et al. | 273/216 |
| 5,628,699 A | | 5/1997 | Maruko et al. | 473/363 |
| 5,704,852 A | | 1/1998 | Kato et al. | 473/357 |
| 5,848,942 A | | 12/1998 | Kato | 473/365 |
| 5,849,392 A | | 12/1998 | Hamada et al. | 428/159 |
| 5,853,337 A | | 12/1998 | Moriyama et al. | 473/365 |
| 6,045,459 A | * | 4/2000 | Sugimoto et al. | 473/354 |

FOREIGN PATENT DOCUMENTS

| | | | | |
|---|---|---|---|---|
| GB | 2 134 798 | | 8/1984 | A63B/37/06 |
| GB | 2 311 733 | | 8/1997 | |
| GB | 2311733 A | * | 10/1997 | 273/222 |
| JP | 59-129072 | | 7/1984 | A63B/37/00 |
| JP | 60-72573 | | 4/1985 | A63B/37/00 |
| JP | 60-168471 | | 8/1985 | A63B/37/06 |
| JP | 5-337217 | | 12/1993 | A63B/37/00 |
| JP | 6-54930 | | 3/1994 | A63B/37/00 |
| JP | 6-238013 | | 8/1994 | A63B/37/00 |
| JP | 7-313630 | | 12/1995 | A63B/37/00 |
| JP | 8-224323 | | 9/1996 | A63B/37/00 |
| JP | 9-271537 | | 10/1997 | A63B/37/00 |
| JP | 9-271539 | | 10/1997 | A63B/37/04 |
| JP | 10-108922 | | 4/1998 | A63B/37/00 |
| JP | 10-201881 | | 8/1998 | A63B/37/00 |

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

In a wound golf ball comprising a solid center, a thread rubber layer, and a cover, the solid center has a diameter of 29–37 mm, has such a hardness distribution that the hardness at the outer surface is lower than the hardness at a middle and the difference between the maximum and the minimum of solid center hardness is at least 6 units on JIS-C hardness scale, has a JIS-C hardness of 50–85 at the outer surface, and experiences a deformation of 2–4.5 mm under a 1–50 kg load. The ball exhibits an optimum spin performance when hit with different types of clubs, and affords improved feel, durability, and distance.

4 Claims, 1 Drawing Sheet

WOUND GOLF BALL

This invention relates to a wound golf ball which exhibits a good spin performance upon different club shots and affords satisfactory feel, durability, and distance.

BACKGROUND OF THE INVENTION

Wound golf balls include balls of the type in which a wound core obtained by winding thread rubber about a solid center is enclosed with a cover of an ionomer resin or balata rubber. For improving wound golf balls of this type, there were proposed several approaches including increasing the diameter and reducing the hardness of the solid center. More particularly, (1) the approach of increasing the diameter and reducing the hardness of the solid center is disclosed in JP-A 59-129072, 60-168471, 60-72573, 5-337217, 6-54930, 7-313630, 8-224323, 9-271537, and 10-108922; and (2) the approach of narrowing the hardness distribution of the solid center is disclosed in JP-A 6-238013, 9-271539, and 10-201881.

These proposals, however, have the following problems.

(1) Problems associated with large-diameter and low-hardness solid centers:

(i) By increasing the diameter and reducing the hardness of the solid center, the spin rate of the ball when hit is reduced, which is effective for increasing the distance. However, since the spin rate is reduced on all shots, the ball upon approach shots does not stop on the green as desired, leading to difficult ball control.

(ii) The solid center tends to deform upon thread winding, making it difficult to ensure the quality.

(iii) The thread rubber layer must be accordingly reduced, making it difficult to provide resilience.

(2) Problems associated with narrow hardness distribution solid centers:

If the hardness distribution from a middle to the surface of a solid center is narrow, the solid center in its entirety deforms upon every shot from a driver to a short-iron, to an extent depending on a particular type of club. If the hardness of the solid center is made uniformly low (soft) so as to reduce the spin rate upon driver shots for increasing the distance, the spin rate upon short-iron shots is also reduced, leading to a shortfall of controllability. Inversely, if the hardness of the solid center is made high (hard) for improving controllability, the spin rate upon driver shots is also increased, leading to a shortfall of distance.

Where the head speed is low enough to produce less deformation of the golf ball as in the case of approach shots, the cover makes a more contribution to the spin rate than the deformation of the ball. For increasing the spin rate for better stop on the green, the cover must then be made soft. When such a soft cover is combined with the improved solid center mentioned above, strikes with other clubs also produce increased spin rates. Then in head wind, the ball will sky high and travel short. It is difficult to provide the ball with a spin performance complying with all types of clubs including a driver and short irons.

SUMMARY OF THE INVENTION

An object of the invention is to provide a wound golf ball having a spin performance complying with all types of clubs and affording a good feel, durability, and increased distance.

It has been found that the spin performance of a golf ball is determined by the deformation of the ball and the friction between the ball and the club face upon impact. The spin rate decreases as the deformation of the ball upon impact becomes greater. Also the spin rate decreases as the cover becomes harder and undergoes less deformation.

To improve the controllability of the ball upon iron shots, it is necessary to make the cover soft so as to receive more spin. However, a mere attempt to soften the cover for increasing the spin rate produces a ball which will travel a too high trajectory when hit with a driver or iron against head wind, covering a shorter distance. This necessitates a study to optimize the deformation of the ball relative to the cover hardness.

The invention is directed to a wound golf ball comprising a solid center, a thread rubber layer formed by winding thread rubber around the solid center, and a cover enclosing the thread rubber layer. It has been found that by optimizing the diameter, the hardness distribution, the difference between maximum hardness and minimum hardness, the surface hardness, and the deformation under an increasing load of the solid center, the golf ball is given an improved spin performance capable of complying with any of different golf scenes covering a wide range of club and head speed variables. Additionally, the ball affords a good feel, high durability and increased distance.

It has also been found that by further specifying the deformation of the solid center under an increasing load relative to the diameter of the solid center and, if necessary, further specifying the material and hardness of the cover, there is obtained a golf ball in which the solid center not only undergoes a greater, yet not excessive, amount of deformation than conventional solid centers, when hit at a high head speed with a greater impact force as in driver shots, but also undergoes adequate deformation even when hit at a low head speed with a smaller impact force as in short-iron shots. This ensures that the ball is improved in feel, durability and distance. The invention is predicated on these findings.

Accordingly, the invention provides a wound golf ball comprising a solid center, a thread rubber layer formed by winding thread rubber around the solid center, and a cover enclosing the thread rubber layer. The solid center having a middle and an outer surface has a diameter of 29 to 37 mm, has such a hardness distribution that the hardness at the outer surface is lower than the hardness at the middle and the difference between the maximum and the minimum of solid center hardness is at least 6 units on JIS-C hardness scale, has a JIS-C hardness of 50 to 85 at the outer surface, and experiences a deformation of 2 to 4.5 mm when the load applied thereto is increased from an initial load of 1 kg to a final load of 50 kg.

In one preferred embodiment, A representing the diameter (mm) of the solid center and B representing the deformation (mm) of the solid center when the load applied thereto is increased from an initial load of 1 kg to a final load of 50 kg satisfy the following relationship:

$$-0.1\times A+5\leqq B\leqq -0.3\times A+14.$$

In a further preferred embodiment, the cover is composed mainly of an ionomer resin and has a Shore D hardness of 40 to 60.

DETAILED DESCRIPTION OF THE INVENTION

Figure 1:
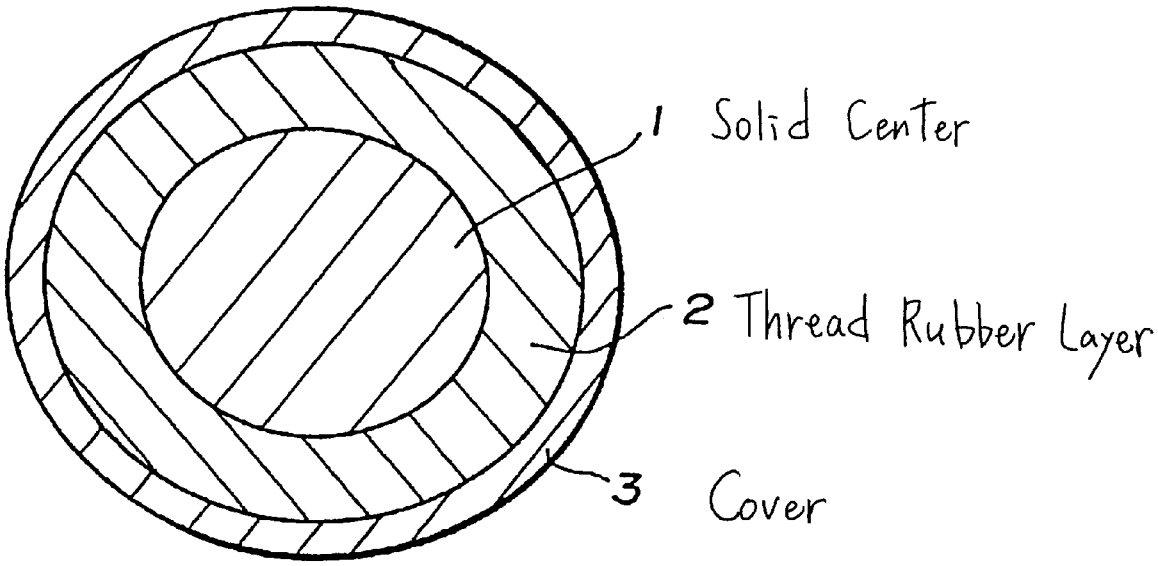
FIG. 1 shows a golf ball according to the present invention.

The wound golf ball of the invention as shown in FIG. 1 has the structure that thread rubber 2, is wound about a solid center 1, to form a wound core which is enclosed with a cover 3.

The solid center used herein may be formed from a well-known rubber composition comprising a base rubber, a co-crosslinking agent, an organic peroxide, an inert filler, an antioxidant and other addenda, by molding under heat and pressure.

First, the base rubber used herein may be poly-butadiene or mixtures of polybutadiene and polyisoprene rubber, which are commonly used in conventional solid centers. Especially for high resilience, cis-1,4-polybutadiene having at least 40% of cis structure is preferably used.

Examples of the co-crosslinking agent include zinc and magnesium salts of unsaturated fatty acids such as methacrylic acid and acrylic acid, and ester compounds such as trimethylpropane trimethacrylate. Zinc diacrylate is preferably used for high resilience. An appropriate amount of the co-crosslinking agent blended is at least 10 parts, especially at least 15 parts by weight and up to 40 parts, especially up to 35 parts by weight, per 100 parts by weight of the base rubber, though not critical.

As the peroxide, a choice may be made from commercially available peroxide products such as Perhexine 2,5B or a mixture of Perhexine 2,5B with Percumyl D and Perhexa 3M (all available from Nippon Oils and Fats K.K.). Such a peroxide product may be used in an amount of at least 0.5 part, especially at least 0.8 part by weight, and up to 4.0 parts, especially up to 3.5 parts by weight, per 100 parts by weight of the base rubber, provided that the product contains 40% by weight of peroxide.

The preferred antioxidant is a bisphenol antioxidant which is commercially available under the trade name of Nocrack NS-6 from Ouchi Shinko Kagaku Kogyo K.K. The antioxidant may be used in an amount of at least 0.2 part, especially at least 0.4 part by weight, and up to 1.2 parts, especially up to 1.0 part by weight, per 100 parts by weight of the base rubber.

Examples of the inert filler include zinc white, barium sulfate, silica, calcium carbonate and zinc carbonate. Often, zinc white and barium sulfate are preferably used. The amount of the filler blended may be properly determined. It is recommended for improving the resilience of the solid center that zinc white account for at least 30%, especially at least 50% by weight of the entire filler. While it is a common practice to freeze the solid center with dry ice for preventing the solid center from deforming when thread rubber is wound thereon, aroma oil may be blended in the composition in an amount of at least 2%, especially at least 5% by weight and up to 20%, especially up to 15% by weight based on the base rubber for the purpose of ensuring that the solid center is effectively frozen.

The solid center can be prepared from the above-described material by well-known methods. For example, after the components are kneaded in a mixer such as a Banbury mixer or roll mill, the kneaded material is placed in a center-forming mold where it is heated to a sufficient temperature for the co-crosslinking agent and peroxide to work, thereby effecting vulcanization or cure. It is noted that in order that the solid center have an optimum hardness distribution to be described later, the vulcanization temperature is preferably at least 140° C., especially at least 145° C. and up to 180° C., especially up to 175° C.

The solid center is formed to a diameter of at least 29 mm, especially at least 32 mm and up to 37 mm, especially up to 34 mm. Too small a solid center diameter may fail to reduce the spin rate upon driver shots, resulting in a shorter distance. With too large a diameter, a sufficient amount of thread rubber cannot be wound, failing to provide sufficient resilience. This would invite such deficiencies as a lower initial velocity, greater deformation upon impact, less spin upon iron shots, and a loss of control.

With respect to the hardness of the solid center, the hardness at the outer surface should be lower than the hardness at the middle. Specifically, the solid center at the outer surface should have a JIS-C hardness of at least 50, preferably at least 54, more preferably at least 56, and up to 85, especially up to 80. If the JIS-C hardness at the outer surface is too low, the solid center is likely to deform during thread winding. If the JIS-C hardness at the outer surface is too high, more spin is imparted upon shots, resulting in a shorter distance.

The difference between the maximum hardness and the minimum hardness throughout the solid center should be at least 6 units on JIS-C hardness scale, preferably at least 7 units, more preferably at least 8 units and up to 12 units, more preferably up to 10 units on JIS-C hardness scale.

The maximum hardness and the minimum hardness of the solid center are determined by measuring the hardness at plural locations from the solid center's center to the outer surface. The difference between the maximum and the minimum is then calculated. One exemplary procedure for a solid center having a diameter of 32 mm involves cutting the solid center into halves, polishing the cut surface smooth, measuring the hardness at random locations, for example, five locations including (1) the solid center's center, (2) 5 mm radially outward from the center, (3) 10 mm radially outward from the center, (4) 12 mm radially outward from the center, and (5) the outer surface, and subtracting the minimum from the maximum among these five measurements. The term "middle" indicates a location falling within the region of the solid center having 70% of its diameter. The hardness measured on the cut surface at a location 2 or 3 mm spaced radially inward from the outer surface is excluded from the hardness at the middle.

The solid center should experience a deformation or deflection of at least 2.0 mm, preferably at least 2.1 mm and up to 4.5 mm, preferably up to 4.0 mm, when the load applied thereto is increased from an initial load of 1 kg to a final load of 50 kg (referred to as 1–50 kg load, hereinafter). Too small deformation allows for too much spin upon shots. With too much deformation, the solid center, even though frozen, would deform when thread rubber is wound thereon.

Provided that A represents the diameter (mm) of the solid center and B represents the deformation (mm) of the solid center under the 1–50 kg load, the solid center should preferably satisfy the following relationship:

$$-0.1\times A+5 \leqq B \leqq -0.3\times A+14.$$

No particular limits are imposed on the weight and resilience of the solid center. Preferably the solid center has a weight of at least 16 g, especially at least 17 g and up to 30 g, especially up to 29 g. The solid center should preferably exhibit a rebound of at least 96 cm, especially at least 97 cm, when it is dropped from a height of 120 cm onto a cylindrical base of iron dimensioned a diameter of 1.0 cm and a height of 10 cm.

Next, thread rubber is wound around the solid center to form a wound core. Well-known methods are employed to wind thread rubber under high tension around the solid center as such or which has been frozen for preventing deformation. The thread rubber used herein may be a well-known one, for example, thread of a rubber composition based on polyisoprene rubber. No particular limits are imposed on the shape, size and properties of thread rubber although it preferably has a specific gravity of at least 0.93 and up to 1.1, especially up to 1.0, a width of at least 1.4 mm, especially at least 1.5 mm and up to 2.0 mm, especially up to 1.7 mm, a thickness of at least 0.3 mm, especially at least 0.4 mm and up to 0.7 mm, especially up to 0.6 mm, and an aspect ratio (thickness/width) of at least 0.3, especially at least 3.5 and up to 0.7, especially up to 0.5.

The thread rubber may be wound by any desired techniques, for example, random or basket winding and great circle winding. The elongation of thread rubber during winding is set as high as possible in order to secure an appropriate deformation capability. Too high a degree of elongation may cause thread rubber to snap during winding, resulting in low production yields, and adversely affect the durability and feel of the resultant ball. For this reason, the thread rubber is preferably wound under an elongation of about 7 to 10 folds, especially about 8 to 9 folds of the original length. To optimize the density of the thread rubber layer, it is recommended that the interstices defined among overlying thread rubber turns be uniformly distributed throughout the thread rubber layer. To this end, thread rubber turns preferably intersect at an angle of about 12 to 45 degrees.

For optimizing the deformation of the ball upon impact, the thread rubber layer preferably has a packing fraction of at least 0.65 g/cm$^3$, especially at least 0.70 g/cm$^3$ and up to 0.90 g/cm$^3$, especially up to 0.85 g/cm$^3$, the packing factor being (overall weight of thread rubber)/(volume of thread rubber layer)/(specific gravity of thread rubber). If the packing fraction is below the range, the ball may undergo more deformation, receive a reduced spin rate even when the surface hardness of the ball is made relatively low, and lose controllability. If the packing fraction is above the range, the ball may undergo less deformation, give an unpleasant feel, and produce too much spin upon driver shots, resulting in a shorter distance.

The wound golf ball of the invention is obtained by enclosing the wound core (solid center plus thread rubber) with the cover while the cover may be a single layer or a multilayer structure of two or more layers.

When the cover is formed as a single layer or a multilayer structure of two or more layers, well-known cover materials may be used. For example, an ionomer resin is used alone or in admixture with an ethylene-methacrylic acid copolymer or ethylene-methacrylic acid-acrylate copolymer.

As the ionomer resin, well-known ones may be used. For example, Himilan 1855, 1856 and 1652 (Dupont-Mitsui Polychemical K.K.), Surlyn 8120, 7930, AM7311 and AM8542 (Dupont) may be used alone or in admixture of two or more. In particular, the use of ionomer resins having two or more neutralizing metal ions is preferred. It is recommended to use a mixture of two or more ionomer resins having different neutralizing metal ions. Exemplary combinations of neutralizing metal ions are Zn/Na, Mg/Li, and Mg/Na.

Examples of the ethylene-methacrylic acid copolymer include Nucrel N1560 (Dupont-Mitsui Polychemical K.K.).

Examples of the ethylene-methacrylic acid-acrylate copolymer include Nucrel AN4311, AN4213C and NO35C (Dupont-Mitsui Polychemical K.K.).

In the practice of the invention, it is recommended to use an ionomer resin alone as the cover material. Where an ionomer resin is used in admixture with an ethylene-methacrylic acid copolymer or ethylene-methacrylic acid-acrylate copolymer, the content of the ethylene-methacrylic acid copolymer or ethylene-methacrylic acid-acrylate copolymer is usually adjusted to less than 50%, preferably up to 45% by weight and at least 5%, especially at least 10% by weight based on the overall cover material. If the ethylene-methacrylic acid copolymer or ethylene-methacrylic acid-acrylate copolymer content is too high, the ball can be scraped or fluffed upon strikes, giving rise to a durability problem. If the same content is too low, the cover may become hard, leading to a loss of control upon iron shots.

The hardness to which the cover is formed of the above-described cover material is not critical. Where the cover is formed of an ionomer resin alone, it is recommended that the cover have a Shore D hardness of at least 40, especially at least 44 and up to 60, especially up to 56. If the Shore D hardness of the cover is too low, the ball may acquire much spin leading to a shorter distance. If the Shore D hardness is too high, the ball may lose controllability.

Preferably the cover has a specific gravity of at least 0.95, especially at least 0.97 and up to 1.3, especially up to 1.2.

When the cover is formed from the above-described cover material as a single layer cover, its thickness is preferably at least 1 mm, especially at least 1.5 mm and up to 3.2 mm, especially up to 2.5 mm. When the cover is formed to a structure of two or more layers, the cover outermost layer should preferably have a thickness of at least 0.4 mm, especially at least 0.6 mm and up to 1.6 mm, especially up to 1.4 mm. Where cover layers other than the outermost layer are formed, they are adjusted such that the total may have the same thickness and Shore D hardness as the single layer cover. If the cover thickness is below the above-described range, an increase of spin upon approach shots may not be expected and the ball may become less durable. If the cover thickness is beyond the range, resilience and hence, distance may be reduced.

In enclosing the wound core with the cover material, any of well-known methods may be used. For example, using cover materials for inner and outer layers, pairs of hemispherical half-cups are respectively formed. The inner and outer layer half-cups are mated and joined to give a pair of two-layer half-cups. The wound core is encased in the pair of two-layer half-cups, followed by compression molding at 110 to 160° C. for about 2 to 10 minutes. An alternative method involves encasing the wound core in only a pair of inner layer half-cups, compression molding the assembly at 110 to 160° C. for about 2 to 10 minutes, placing the resulting structure in an injection mold, and injection molding the outer layer cover material therearound.

On the cover surface, a multiplicity of dimples are generally formed in a conventional manner. The number of dimples is usually at least 350, preferably at least 370, more preferably at least 390 and at most 500, preferably at most 480, more preferably at most 450. A smaller number of dimples may require discrete dimples to be increased in diameter, detracting from the roundness of the ball. A larger number of dimples may require discrete dimples to be reduced in diameter, losing the aerodynamic effect of dimples.

No particular limits are imposed on the diameter, depth and cross-sectional shape of dimples. Usually the dimples have a diameter of 1.4 mm to 2.2 mm and a depth of 0.15 to 0.25 mm. Two or more types of dimples which differ in diameter and/or depth may also be formed.

Preferably the dimples are formed to provide a percent dimple surface coverage of at least 65%, more preferably at least 70% and up to 80%, more preferably up to 78%. Provided that the golf ball is an imaginary sphere having no dimples, the percent dimple surface coverage is defined as the total of surface areas on the imaginary sphere surrounded by the edge of dimples divided by the surface area of the imaginary sphere. If the dimple surface coverage is too small, satisfactory aerodynamic effects, especially distance might be lost. If the dimple surface coverage is too large, the land between opposed dimple edges becomes narrow so that scraping may easily occur upon iron shots.

Also preferably the ball has a percent dimple volume of at least 0.76%, more preferably at least 0.78% and up to 1.1%, more preferably up to 1.04%. The percent dimple volume is defined as the overall dimple volume (that is, the sum of dimple volumes) divided by the volume of an imaginary sphere given on the assumption that no dimples are formed in the golf ball surface. Too small a percent dimple volume may lead to a higher trajectory and a shorter distance. Too large a percent dimple volume may lead to a lower trajectory a and a shorter distance.

Desirably the product of the dimple volume ($mm^3$) and the square root of average dimple diameter (mm) is at least 500, especially at least 550 and up to 800, especially up to 750.

The geometrical arrangement of dimples may be an octahedral or icosahedral arrangement, for example. The pattern of dimples is not limited to a circle, and any of square, hexagon, pentagon and triangle patterns may be employed.

The golf ball of the invention has a diameter and weight complying with the Rules of Golf, that is, a diameter of not less than 42.67 mm and a weight of not greater than 45.93 g.

EXAMPLE

Examples of the invention are given below by way of illustration and not by way of limitation.

Examples 1–6 and Comparative Examples 1–3

Solid centers were prepared by formulating the rubber compositions shown in Table 1 and pressure molding the compositions under the vulcanizing conditions shown in Table 1. The components shown in Table 1 are shown below.

Solid Center Formulation

BR01: high-cis-polybutadiene by Japan Synthetic Rubber K.K.

Antioxidant: Nocrack NS-6 by Ouchi Shinko Kagaku Kogyo K.K.

Perhexine 2,5B: peroxide content 40% by Nippon Oils and Fats K.K.

Perhexa 3M: pure product by Nippon Oils and Fats K.K.

Percumyl D: pure product by Nippon Oils and Fats K.K.

Solid Center Parameters

The diameter, weight and deformation of solid center each are an average of twelve samples, with the deformation being a deformation (mm) under 1–50 kg load.

JIS-C Hardness

JIS-C hardness was determined by cutting five solid centers into halves, polishing the cut surface flat, measuring the hardness at five locations including (1) the solid center's center, (2) 5 mm radially outward from the center, (3) 10 mm radially outward from the center, (4) 12 mm radially outward from the center, and (5) the outer surface, and calculating an average at each location. By subtracting the minimum from the maximum, JIS-C hardness difference was determined.

Next, thread rubber of the following composition and parameters was wound on the solid centers to produce wound cores.

| Thread rubber composition | Parts by weight |
|---|---|
| Polyisoprene rubber | 70 |
| Natural rubber | 30 |
| Zinc white | 1.5 |
| Stearic acid | 1 |
| Vulcanization accelerator | 1.5 |
| Sulfur | 1 |

Specific gravity: 0.93

500% modulus: 15 $kg/cm^2$

Size: width 1.55 mm, thickness 0.55 mm

Next, each of the cover materials shown in Table 2 was kneaded in a twin-screw extruder and formed into a pair of hemispherical half-cups. The wound core was encased in the pair of hemispherical half-cups, which was compression molded at 145° C. for 5 minutes, obtaining wound golf balls. The balls on the surface each had 396 dimples at a percent dimple surface coverage of 76% and a percent dimple volume of 0.88%.

Using a swing robot by Miyamae K.K., the thus obtained golf balls were hit with a driver (W#1), iron (I#9) and sand wedge (SW) at a head speed (HS) of 45 m/s, 36 m/s and 20 m/s, respectively. The driver (W#1) used was Tour Stage X100, loft 10°; the iron (I#9) was Tour Stage 55-HM, loft 44°; and the sand wedge (SW) was Tour Stage 55-HM, loft 58°, all by Bridgestone Sports Co., Ltd. An initial velocity, elevation angle, carry, total distance and spin rate were determined, with the results shown in Table 3.

With respect to feel, five male professional golfers hit the balls and rated the feel "O" when soft and pleasant and "X" when hard.

TABLE 1

| | Solid center | | | | | | | | |
|---|---|---|---|---|---|---|---|---|---|
| | A | B | C | D | E | F | G | H | I |
| Composition (pbw) | | | | | | | | | |
| BR01 | 100 | 100 | 100 | 100 | 100 | 100 | 100 | 100 | 100 |
| Zinc diacrylate | 23 | 23 | 23 | 22 | 20 | 25 | 25 | 21 | 27 |
| Zinc white | 31 | 40 | 20 | 31 | 31 | 31 | 31 | 31 | 31 |
| Barium sulfate | 31 | 40 | 27 | 32 | 32 | 30 | 31 | 31 | 29 |
| Antioxidant | 0.4 | 0.4 | 0.4 | 0.4 | 0.2 | 0.4 | 0.7 | | 0.4 |
| Perhexine 2, 5B | 1.2 | 1.2 | 1.2 | 1.2 | 1.2 | 1.2 | | | 1.2 |
| Perhexa 3M | 1.0 | 0.8 | 0.8 | 0.6 | 0.6 | 1.0 | 0.6 | 0.6 | 1.0 |
| Percumyl D | | | | | | | 0.6 | 0.6 | |
| Vulcanization | | | | | | | | | |
| Temperature (° C.) | 170 | 170 | 170 | 155 | 155 | 165 | 155 | 155 | 170 |
| Time (min) | 15 | 15 | 15 | 15 | 15 | 15 | 15 | 15 | 15 |
| Parameters | | | | | | | | | |
| Diameter (mm) | 32.0 | 29.7 | 33.9 | 32.0 | 32.0 | 32.0 | 32.0 | 32.0 | 32.0 |
| Weight (g) | 23.8 | 20.3 | 26.6 | 23.8 | 23.8 | 23.7 | 23.9 | 23.7 | 23.7 |
| Deformation (mm) | 2.65 | 2.60 | 2.58 | 2.92 | 3.47 | 2.14 | 2.51 | 2.36 | 1.85 |
| JIS-C hardness | | | | | | | | | |
| Center | 66 | 65 | 67 | 67 | 61 | 72 | 68 | 55 | 75 |
| 5 mm from center | 70 | 69 | 70 | 68 | 65 | 75 | 69 | 62 | 78 |
| 10 mm from center | 70 | 68 | 68 | 67 | 64 | 75 | 70 | 70 | 79 |
| 12 mm from center | 67 | 64 | 65 | 62 | 60 | 72 | 68 | 74 | 77 |
| outer surface | 62 | 62 | 64 | 60 | 56 | 68 | 68 | 78 | 73 |

TABLE 2

| | Cover material | a | b |
|---|---|---|---|
| Composition (pbw) | Himilan 1554 | — | 100 |
| | Himilan 1650 | 20 | — |
| | Himilan 1855 | 30 | — |
| | Surlyn 8120 | 30 | — |
| | Nucrel 1560 | 20 | — |
| | Barium sulfate | 1 | 1 |
| | Titanium oxide | 2 | 2 |
| | Dispersant/pigment | 1 | 1 |
| Physical properties | MFR (g/10 min) | 2.1 | 1.0 |
| | Shore D hardness | 51 | 55 |

TABLE 3

| | Example | | | | | | Comparative Example | | |
|---|---|---|---|---|---|---|---|---|---|
| | 1 | 2 | 3 | 4 | 5 | 6 | 1 | 2 | 3 |
| Solid center | | | | | | | | | |
| Composition | A | B | C | D | E | F | G | H | I |
| Diameter (mm) | 32.0 | 29.7 | 33.9 | 32.0 | 32.0 | 32.0 | 32.0 | 32.0 | 32.0 |
| Deformation (mm) | 2.65 | 2.60 | 2.58 | 2.92 | 3.47 | 2.14 | 2.51 | 2.36 | 1.85 |
| JIS-C hardness difference | 8 | 7 | 6 | 8 | 9 | 7 | 2 | 23 | 6 |
| Cover | | | | | | | | | |
| Composition | a | b | a | a | a | a | a | a | a |
| Gage (mm) | 1.7 | 1.7 | 1.7 | 1.7 | 1.7 | 1.7 | 1.7 | 1.7 | 1.7 |
| Shore D hardness | 51 | 55 | 51 | 51 | 51 | 51 | 51 | 51 | 51 |

TABLE 3-continued

| | Example | | | | | | Comparative Example | | |
|---|---|---|---|---|---|---|---|---|---|
| | 1 | 2 | 3 | 4 | 5 | 6 | 1 | 2 | 3 |
| Ball | | | | | | | | | |
| Weight (g) | 45.3 | 45.3 | 45.2 | 45.3 | 45.3 | 45.2 | 45.3 | 45.3 | 45.3 |
| Diameter (mm) | 42.67 | 42.67 | 42.68 | 42.68 | 42.67 | 42.68 | 42.68 | 42.68 | 42.67 |
| Deformation (mm)* | 3.01 | 3.00 | 2.98 | 3.03 | 3.00 | 3.05 | 3.00 | 3.02 | 3.00 |
| Ball performance | | | | | | | | | |
| W#1, HS = 45 m/s | | | | | | | | | |
| Initial velocity (m/s) | 65.6 | 65.7 | 65.5 | 65.6 | 65.4 | 65.5 | 65.3 | 65.4 | 65.1 |
| Spin (rpm) | 2830 | 2950 | 2720 | 2800 | 2780 | 2910 | 2910 | 2840 | 3000 |
| Elevation angle (°) | 10.0 | 10.2 | 10.0 | 10.0 | 10.0 | 10.2 | 10.2 | 10.1 | 10.3 |
| Carry (m) | 205.3 | 205.9 | 206.0 | 205.5 | 206.7 | 206.0 | 205.8 | 205.4 | 203.2 |
| Total (m) | 218.3 | 216.7 | 220.1 | 218.7 | 219.8 | 217.2 | 217.2 | 218.1 | 214.1 |
| I#9 HS = 36 m/s | | | | | | | | | |
| Spin (rpm) | 8450 | 8600 | 8400 | 8480 | 8380 | 8500 | 8830 | 8670 | 8960 |
| Carry (m) | 104.3 | 104.2 | 104.9 | 104.3 | 104.8 | 104.0 | 100.5 | 102.2 | 100.1 |
| SW, HS = 20 m/s | | | | | | | | | |
| Spin (rpm) | 5800 | 5700 | 5730 | 5780 | 5810 | 5830 | 5840 | 5780 | 5890 |
| Feel | ○ | ○ | ○ | ○ | ○ | ○ | ○ | ○ | X |

*Deflection under an applied load of 100 kg.

There has been described a wound golf ball which when hit with all types of clubs, exhibits an optimum spin performance and affords a good feel, durability, and increased distance.

Japanese Patent Application No. 11-190213 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A wound golf ball comprising a solid center, a thread rubber layer formed by winding thread rubber around the solid center, and a cover enclosing the thread rubber layer, said solid center having a middle and an outer surface has a diameter of 29 to 37 mm, has such a hardness distribution that the hardness at the outer surface is lower than the hardness at the middle and the difference between the maximum and the minimum of solid center hardness is from 6 to 12 units on JIS-C hardness scale, has a JIS-C hardness of 50 to 85 at the outer surface, and experiences a deformation of 2 to 4.5 mm when the load applied thereto is increased from an initial load of 1 kg to a final load of 50 kg.

2. The wound golf ball of claim 1 wherein A representing the diameter (mm) of said solid center and B representing the deformation (mm) of said solid center when the load applied thereto is increased from an initial load of 1 kg to a final load of 50 kg satisfy the following relationship:

$$-0.1\times A+5\leqq B\leqq -0.3\times A+14.$$

3. The wound golf ball of claim 1 wherein said cover is comprised of an ionomer resin and has a Shore D hardness of 40 to 60.

4. The wound golf ball of claim 1, wherein said difference between the maximum and the minimum of solid center hardness is from 6 to 9 units on the JIS-C hardness scale.

* * * * *